United States Patent [19]

King et al.

[11] Patent Number: 4,553,515

[45] Date of Patent: Nov. 19, 1985

[54] CYLINDER HEAD FOR SPARK IGNITION INTERNAL COMBUSTION ENGINE

[75] Inventors: Charles S. King, Warwickshire; Joseph J. Poole, Coventry, both of England

[73] Assignee: BL Technology Limited, England

[21] Appl. No.: 659,787

[22] Filed: Oct. 11, 1984

[30] Foreign Application Priority Data

Oct. 22, 1983 [GB] United Kingdom ..... 8328319

[51] Int. Cl.[4] ..... F02F 1/32

[52] U.S. Cl. ..... 123/308; 123/432; 123/315; 123/193 H; 123/90.27; 123/90.4

[58] Field of Search ..... 123/432, 308, 26, 193 H, 123/315, 90.16, 90.23, 90.27, 90.4, 302, 90.44

[56] References Cited

U.S. PATENT DOCUMENTS

| | | | |
|---|---|---|---|
| 4,216,748 | 8/1980 | Ichida | 123/432 |
| 4,267,811 | 5/1981 | Springer | 123/193 H |

FOREIGN PATENT DOCUMENTS

| | | | |
|---|---|---|---|
| 783318 | 7/1935 | France | 123/90.27 |
| 0043228 | 3/1980 | Japan | 123/41.82 R |
| 123658 | 3/1919 | United Kingdom . | |
| 942420 | 11/1963 | United Kingdom . | |
| 1256401 | 12/1971 | United Kingdom . | |

*Primary Examiner*—Craig R. Feinberg
*Assistant Examiner*—David A. Okonsky
*Attorney, Agent, or Firm*—Thomas J. Greer, Jr.

[57] ABSTRACT

A cylinder head 1 has four valves 2, 4 per cylinder and the desirable arrangement whereby the sparking plug 7 electrodes are in the center of the four valves. The sparking plug 7 is housed in a tube 29 to protect it from the oil in the valve gear region of the head. By appropriate choice of dimensions, it has been found possible to operate the valves 2, 4 via rockers 9, 11 by means of a camshaft 18 located in the vee-space between the valves, while still allowing room to accommodate the sparking plug 7. A desirable compactness is thereby achieved.

9 Claims, 2 Drawing Figures

CYLINDER HEAD FOR SPARK IGNITION INTERNAL COMBUSTION ENGINE

This invention relates to cylinder heads for spark ignition internal combustion engines, and especially to such engines utilising four valves per cylinder.

Four valves per cylinder are often operated by twin overhead camshafts, one camshaft operating the pairs of inlet valves and the other camshaft operating the pairs of outlet valves, permitting location of the sparking plug such as to give a central location of the spark gap.

It is known to operate four valves per cylinder by a single overhead camshaft for example as in the Rolls-Royce Merlin (Trade Mark) aero engine or as in Bentley (Trade Mark) motor cars before 1930, but in both cases the spark gap was not located centrally in the combustion chamber.

It is however known for four valves to be operated by a single overhead camshaft with central spark gap location, namely, in the Applicants DOLOMITE SPRINT (Trade Mark) cylinder head, which is the subject of United Kindom Pat. No. 1 331 226. In this arrangement, the camshaft operates directly on bucket tappets on the inlet valves and indirectly via rockers on the exhaust valves. The inlet and exhaust valves are inclined relative to each other when viewed in a direction parallel to the camshaft axis. To achieve central gap positioning, the sparking plug is located between the inclined valves and is only accessible through the part of the cylinder head housing the valve gear.

The Applicants are also aware of the common two valve per cylinder arrangement, in which a single overhead camshaft operates both valves via rockers, in which the valves are inclined relative to each other when viewed in a direction parallel to the camshaft axis and in which the camshaft lies between the valve stems in the vee-shaped space so created, below the pivot axis or axes of the rockers (with the cylinders being viewed in an upright orientation). The sparking plug is set at a relatively shallow angle to the face of the piston in order to avoid the camshaft and associated equipment and to be accessible from the outside of the cylinder head.

The invention provides a cylinder head for a spark ignition internal combustion engine, comprising two inlet and two exhaust valves per cylinder operated by an overhead camshaft, the inlet and exhaust valves being inclined relative to each other when viewed in a direction parallel to the camshaft axis and each sparking plug being positioned with its axis within the angle defined by the axes of the inlet and exhaust valves when viewed in the same direction and with the spark gap lying between the heads of the four valves, wherein the camshaft operates the valves via rockers and the axis of the camshaft is nearer to the face of the cylinder head than is the axis of each rocker.

The location of the camshaft below the pivot axis of each rocker, with the cylinders viewed in an upright orientation, enables the overall height of the cylinder head to be reduced as compared with the twin overhead camshaft system or the Applicants DOLOMITE SPRINT (Trade Mark) arrangement, while still permitting the desired central location of the spark plug gap within each cylinder to be achieved.

Advantageously, the camshaft is located in the vee between the inclined inlet and exhaust valves. To accommodate the sparking plug, the camshaft is preferably spaced further from one pair of valves than from the other pair, and in the case where two rocker shafts are provided, one for the inlet and one for the exhaust valves, the pivot axis of one rocker shaft is preferably spaced further from its associated valves than is the pivot axis of the other.

As mentioned two rocker shafts may be provided, one for the inlet valves and the other for the exhaust valves, but one rocker shaft may be used if desired, carrying rockers for both inlet and exhaust valves.

A cylinder head for a spark ignition combustion engine will now be described, by way of example, with reference to the accompanying drawings, in which.

Figure 1:
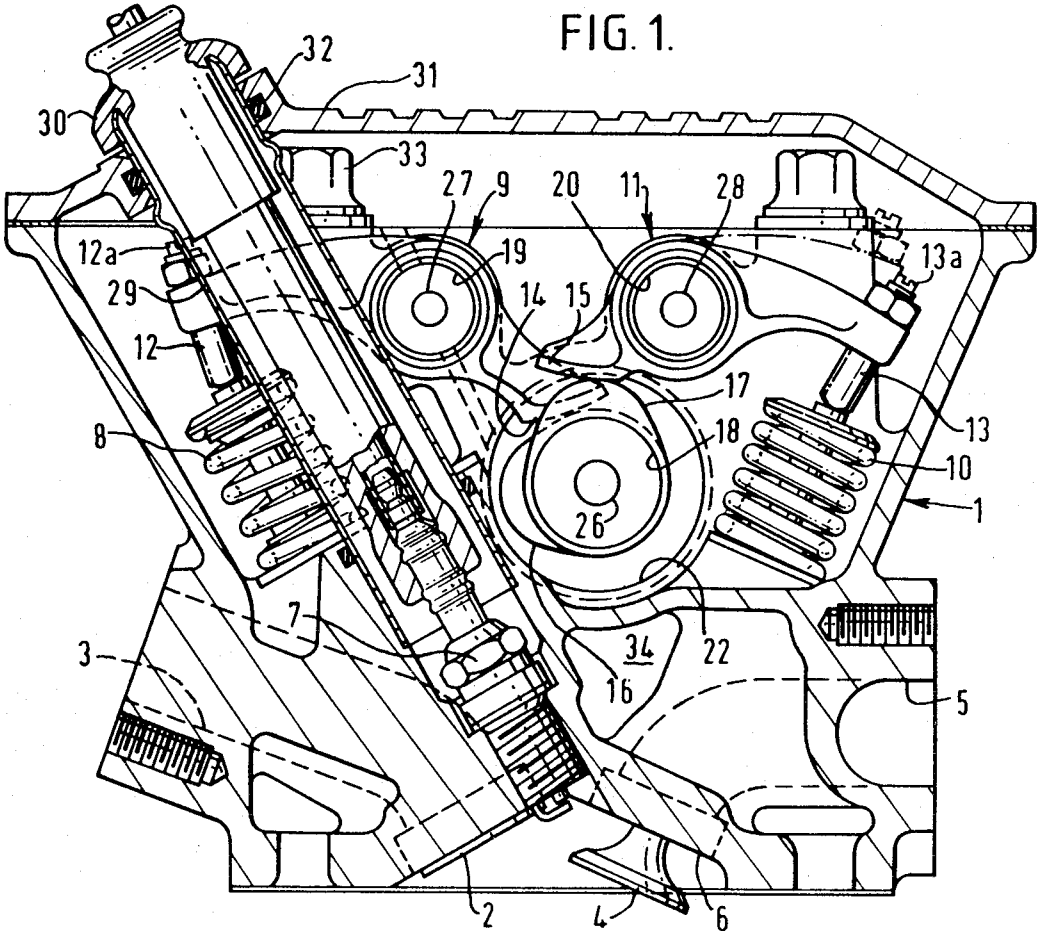
FIG. 1 is a transverse section through the cylinder head.
Figure 2:
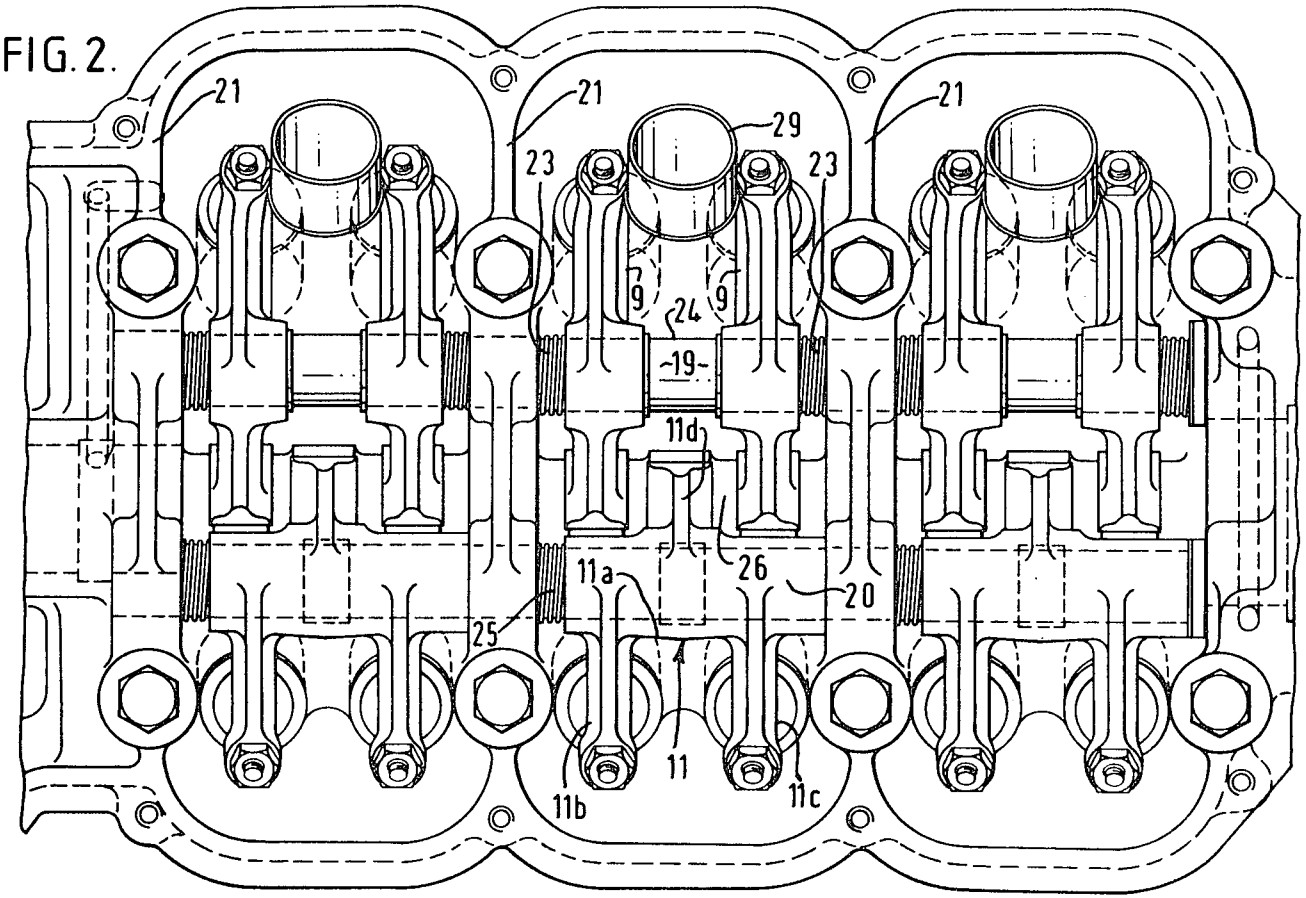
FIG. 2 is a plan view of the head.

The cylinder head 1 is for a three cylinder engine and has four valves per cylinder. Each cylinder has two inlet valves 2 at the end of inlet tracts 3 and two exhaust valves 4 at the ends of the exhaust tracts 5. The valves seat in a penthouse-type combustion chamber 6. Each cylinder has a sparking plug 7 which enters the combustion chamber such that the spark gap is located approximately centrally between the four valves.

The inlet valves 2 are opened against the usual valve springs 8 by rockers 9 and the exhaust valves 4 are opened against valves springs 10 by a one-piece rocker 11. The outer ends of the rocker 9 and both outer ends of rocker 11 engage the ends of the respective valve stems by spherically-ended bolts 12*a*, 13*a*. The inner ends of the rockers 9 have pads 14 which engage cams 16 on camshaft 18, and the inner end of each rocker 11 has a single pad 15 which engages cams 17 on camshaft 18.

The camshaft 18 and the shafts 19, 20 on which the rockers 9 and 11 are mounted are assembled by being inserted longitudinally through apertures in the webs 21 and then secured against lenghwise movement by means which are not shown. In the case of the rocker shafts 19, 20 the rockers 9, 11 are slid onto the rocker shafts as they are being inserted, and the web apertures act as end location for the rockers. Springs 23 hold the rockers 9 against spacer collar 24 to locate the rockers on the appropriate cam surfaces. Rocker 11 consists of a long sleeve 11*a* having arms 11*b*, 11*c* for engaging the valve stems and a single arm 11*d* for engaging cam 17. It is located in position by spring 25.

The camshaft 18 has a central oil passageway 26 and drillings (not shown) for lubricating its bearings. Similarly the rocker shafts have oil passageways 27, 28.

The camshaft 18 has a sprocket (not shown) at one end which is driven from the crankshaft.

The sparking plug 7 is protected from the oil in the valve part of the cylinder head by means of a tube 29 closed at the upper end by a plug 30 through which the ignition lead extends. The tube 29 seals against the rocker cover 31 by means of an O-ring 32. The location of the sparking plug not only facilitates combustion since the electrodes are approximately in the centre of the roof of the combustion chamber but also facilitates cooling of the plug by conduction to the incoming charge of air fuel mixture in the inlet tracts 3. Also, the sparking plug location leaves room for a water passage 34 adjacent the plug and exhaust valves seat and ports.

The cylinder head is of aluminium (which term is intended to include alloys thereof). It is secured to the cylinder block by means of bolts 33.

The inlet valve 2 is inclined at 30° to the vertical (as seen in FIG. 1) and the exhaust valve is inclined at between 24° and 25° to the vertical (as seen in FIG. 1).

As will be understood from the foregoing, in operation, the camshaft 18 causes rockers 9, 11 to pivot about shafts 19, 20 and so open up valves 2, 4 respectively.

It will be observed that the layout of the head is exceptionally compact. Not only are the advantages of four valve operation per cylinder achieved with the use of a single overhead camshaft, but also these are achieved in an extremely compact way. Thus, in the Applicants DOLOMITE SPRINT (Trade Mark) cylinder head British Pat. No. 1 331 226) the single overhead camshaft acts directly on the inlet valve stems via a bucket tappet and operates the exhaust valves via rockers. Both the camshaft and the rocker shaft are located above the vee-space between the valves. The Applicants have surprisingly found that by appropriate choice of dimensions, it is possible to locate the camshaft in the vee-space between the valves and drive the valve by means of rockers, while still leaving space for accommodating the sparking plugs with the spark gap in the optimum central location. Another advantage of the construction is that the cylinder head attachment bolts 33 are accessible without dismantling the valve operating gear. This in turn gives the ability to subassemble the valve operating gear in the cylinder head before the head is assembled to the cylinder block. (Although accessible bolts would be possible if the camshaft was located at the top of one of the sets of valve stems, this could not be achieved without restricting the choice of orientations of the valves).

Of course, various modifications may be made from the head described above. Thus, if desired, a single rocker shaft may be provided, and both rockers 9, 11 may pivot on it. Equally the rockers 9 could be made as two separate rockers like rockers 9. Also, instead of bolts 12*a*, 13*a* for adjusting the tappet gap, mechanical automatic means or hydraulic tappets may be used. Also variation of 1° or 2° are possible in the respective angles between the inlet and exhaust valves and vertical (as seen in the Figures).

We claim:

1. A cylinder head for a multiple cylinder spark ignition internal combustion engine, comprising two inlet and two exhaust valves per cylinder operated by a single overhead camshaft, the inlet and exhaust valves being inclined relative to each other when viewed in a direction parallel to a camshaft axis and each sparking plug being positioned within its axis entirely within an area bounded by an angle defined by the axes of the inlet and exhaust valves when viewed in the same direction and with a spark gap lying between heads of the four valves, wherein the camshaft operates the valves via rockers on at least one rocker shaft and the axis of the camshaft is nearer to a face of the cylinder head than is an entire axis of each rocker, and wherein each rocker shaft is continuous along an entire length of the cylinder head.

2. A cylinder head as claimed in claim 1, wherein the camshaft is spaced further from one pair of valves than the other pair.

3. A cylinder head as claimed in claim 1 wherein the rockers for the inlet valves pivot about different axes to the rockers for the outlet valves, and one pivot axis is spaced further from its associated valves than is the other pivot axis.

4. A cylinder head as claimed in claim 1, wherein the camshaft lies in the vee between the inclined inlet and exhaust valves.

5. A cylinder head as claimed in claim 1, wherein the spark gap is located substantially centrally in the combustion chamber.

6. A motor vehicle equipped with an engine as claimed in claim 1.

7. A cylinder head as claimed in claim 1 wherein there is one of said rocker shaft for each intake valve rockers and a second of said rocker shaft for said exhaust valve rockers, said camshaft is spaced further from one pair of said valves than from the other pair of said valves, said sparking plug axis is adjacent said one pair of valves, and said rocker shafts lie between a projection of said spark plug as along said spark plug axis and said other pair of valves.

8. A cylinder head as claimed in claim 1 wherein the angle defined by the axes of the inlet and exhaust valves when viewed in the said direction lies between 35° and 75°.

9. A cylinder head as claimed in claim 8 wherein the angle lies between 45° and 65°.

* * * * *